United States Patent [19]

Yamada et al.

[11] Patent Number: 5,038,694

[45] Date of Patent: Aug. 13, 1991

[54] SMALL SAILING SHIP

[75] Inventors: Toshiharu Yamada, Cypress, Calif.; Kunihiko Kobayashi, Iwata, Japan; James R. Drake, Santa Monica, Calif.

[73] Assignee: Yamaha Hatsudoki Kabushiki Kaisha, Iwata, Japan

[21] Appl. No.: 315,140

[22] Filed: Feb. 24, 1989

[51] Int. Cl.[5] ..... B63H 9/04

[52] U.S. Cl. ..... 114/39.1; 114/61; 114/123

[58] Field of Search ..... 114/39.2, 61, 123, 39.1, 114/292, 56, 57

[56] References Cited

U.S. PATENT DOCUMENTS

| | | | |
|---|---|---|---|
| 4,194,458 | 3/1980 | Messing | 114/39.2 |
| 4,434,737 | 3/1984 | Weiss | 114/39.2 |
| 4,531,922 | 7/1985 | Schutz | 114/39.2 |
| 4,598,659 | 7/1986 | Chinnery | 114/39.2 |

FOREIGN PATENT DOCUMENTS

| | | | |
|---|---|---|---|
| 2405864 | 6/1979 | France | 114/39.2 |
| 2462338 | 3/1981 | France | 114/39.2 |
| 77996 | 5/1984 | Japan | 114/39.2 |

*Primary Examiner*—Sherman Basinger
*Assistant Examiner*—Stephen P. Avila
*Attorney, Agent, or Firm*—Ernest A. Beutler

[57] ABSTRACT

A small sailing watercraft designed to be operated primarily by a single rider standing on the deck and having an improved hull configuration for improved handling in all seas and all wind conditions. The hull is hollow and is formed with a generally narrow displacement hull with a substantially larger deck area closing it so as to accommodate various standing positions for the rider. A pair of sponsons are disposed adjustably at the opposite side of the main hull and are carried by outriggers that are connected to the main hull in an area where it is reinforced by internal bulkheads. The hollow hull also affords a storage compartment.

33 Claims, 8 Drawing Sheets

SMALL SAILING SHIP

BACKGROUND OF THE INVENTION

This invention relates to an improved small sailing ship and more particularly to a small sailing ship having greater versatility than those previously proposed.

There is a very popular type of small sailing craft in which a hull is formed from a material much like a surf board and mounts a mast for pivotal movement normally in all directions relative to the hull. The rider operates this watercraft by standing on the hull and pivoting the mast and swinging the sail carried by the mast. Although this type of sailing vessel has great popularity, it has a number of disadvantages which has limited its use for certain types of pleasure sailing.

For example, because of the configuration of the hull primarily like a surf board and the necessity of the operator to continually control the mast, this type of vessel is only utilized for local sailing and not for long distance cruising. Also, the configuration of the hull is such that the watercraft is not usable in all wind and wave conditions.

It is, therefore, a principal object of this invention to provide an improved small sailing watercraft that has wider versatility than those previously proposed.

It is a further object of this invention to provide an improved hull design for a small watercraft that will permit sailing in a wide variety of conditions and will not overly tire the rider.

It is a further object of this invention to provide an improved hull design for a small sailing watercraft that is both high in strength and which lends itself to long distance cruising.

One way in which the versatility of a small sailing watercraft of this type can be improved is by the use of one or more sponsons that are held to the main hull by outriggers. The use of the sponson will render the craft more stable and will give the operator an opportunity to rest without constant control of the watercraft. However, when sponsons are employed with a small watercraft, there are certain other disadvantages.

For example, the use of sponsons in connection with the watercraft and their attachment to the hull, which should be relatively lightweight in order to permit portability and wider usage, can put loadings that can damage the hull. Although the hull can be strengthened, normal strengthening methods tend to adversely effect the weight of the watercraft which defeats its basic nature.

It is, therefore, a still further object of this invention to provide an improved hull design for a small sailing watercraft of this type having a sponson that is mounted to the main hull by outriggers.

It is a further object of this invention to provide an improved light weight yet high strength small sailing watercraft of this type.

The small sailing watercraft of the board type, in addition to its aforenoted disadvantages, is not particularly advantageous for traveling from place to place because the watercraft does not afford any way in which a rider may carry other belongings with him. Also, a rider wishing to camp at a remote sight cannot use the previous small watercraft for this purpose because he has no place to store his camping gear. For example, if the rider wishes to utilize the watercraft in conjunction with camping, he can never sail far from the campsite because he must leave his property behind.

It is, therefore, a still further object of this invention to provide a small sailing watercraft of this general type wherein the hull provides a storage space for carrying equipment of the rider.

It is a further object of this invention to provide an improved hull design for a small watercraft that provides a storage space without adding to the weight of the watercraft and without adversely affecting its sailing ability.

As has been previously noted, small watercrafts of this type are primarily utilized for sporting purposes. Normally, the watercraft is transported to the location where it will be sailed by motor vehicle. Frequently, these watercrafts are used in beaches or other out of the way places where normal boat launching facilities are not present. When the watercraft is provided with sponsons, the launching of the watercraft from a beach presents substantial difficulties. It is, therefore, a further object of this invention to provide an improved sponson arrangement for a small sailing watercraft that will facilitate launching from a beach site.

It is yet another object of this invention to provide an improved small sailing watercraft having a sponson positioned so as to increase its versatility without detracting from its performance.

SUMMARY OF THE INVENTION

The features of the invention are particularly adapted for use in a small sailing watercraft that is designed for operation primarily by a single rider that operates the craft in a standing fashion. The watercraft is comprised of a main hull that has a substantially greater length than width and a mast that is pivotally supported on the main hull and which is adapted to carry a sail. At least one sponson is carried at one side of the main hull at a point spaced therefrom by at least one outrigger.

In accordance with a first feature of the invention, the main hull is comprised of a relatively narrow displacement hull that is formed at its upper central portion with a deck that is adapted to accommodate a rider standing thereupon and which has substantially greater width than the adjacent portion of the main hull.

In accordance with another feature of the invention, the main hull is comprised of a lower part defining a generally longitudinally extending cavity that is closed by an upper deck portion. At least one bulkhead extends transversely across the cavity for reinforcing the hull. The outrigger is affixed to the main hull contiguous to the bulkhead.

Yet another feature of the invention is also adapted to be embodied in a small watercraft of the type defined. In accordance with this feature of the invention, the main hull also has a lower part that defines a generally longitudinally extending cavity. This cavity provides a storage compartment and removable access means are provided in the main hull for affording the rider an opportunity to insert and remove things from the cavity.

A final feature of the invention is also adapted to be embodied in a small watercraft of the type described. In accordance with this feature of the invention, the outrigger affixes the sponson to the main hull at the forward portion of the watercraft for facilitating launching of the watercraft from a beach.

DETAILED DESCRIPTION OF THE PREFERRED EMBODIMENT OF THE INVENTION

Figure 1:
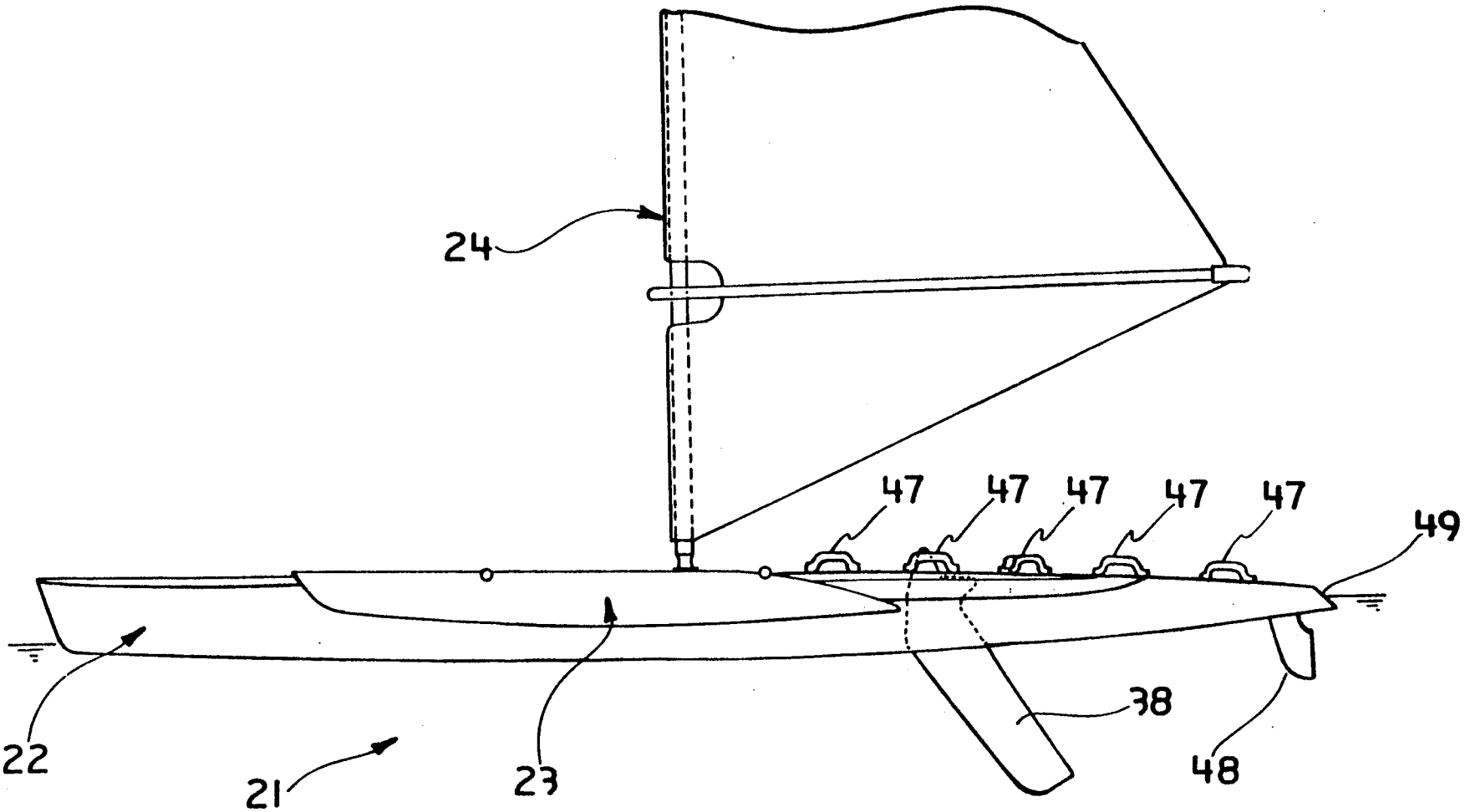
FIG. 1 is a side elevational view, with a portion broken away, of a small sailing watercraft constructed in accordance with an embodiment of the invention.

Referring now in detail to the drawings and initially primarily to FIGS. 1 through 4, a small sailing watercraft constructed in accordance with an embodiment of the invention is identified generally by the reference numeral 21. The watercraft 21 is comprised of a main hull assembly, indicated generally by the reference numeral 22, a pair of sponsons, each indicated generally by the reference numeral 23 and a mast and sail assembly, indicated generally by the reference numeral 24. The main hull assembly 22 and sponsons 23 are conveniently formed from a lightweight high strength material such as a fiberglass reinforced resin or the like. It should be noted that it is extremely important that the watercraft 21, in addition to having good sailing capabilities in all seas and winds, be lightweight in construction so as to be easily portable.

The sponsons 23 are detachably connected to the main hull 22 by respective pairs of outriggers 25. The sponsons 23, as will become apparent, are adjustable relative to the length of the main hull 22 and angularly relative to it. If desired the sponsons 23 also may be adjusted laterally in or out to space the sponsons 23 at desired longitudinal distances from the main hull 22. Any type of known adjusting mechanism may be utilized for these purposes. The sponsons 23 are detachably connected to the outriggers 25 for ease of transportation.

Referring now primarily to the configuration of the main hull 22, this can be best understood by particular reference to FIGS. 4 through 9. The main hull 22 is comprised of a lower part 26, which is configured as will be described, and which defines a longitudinally extending cavity 27. The lower portion 26 is closed by means of an upper hull portion 28 that is suitably affixed to the lower portion 26 and which forms a closure for the main hull cavity 27. This attachment may be in any known manner, such as by chemical bonding or the like.

It should be noted that the main hull lower portion 26 has a pair of transversely extending bulkheads 29 and 31 which are located at a specific location, as will be described, and which serve to divide the cavity 27 into three longitudinally spaced cavities in addition to offering reinforcing.

The hull upper portion 28 is provided with an enlarged deck area 32 on which a rider may stand so as to sail the watercraft 21. There are provided a pair of access openings 33 and 34 in this main deck area 32 which are closed by removable hatches 35 and 36, respectively. The hatches 35 and 36 may be removed so as to afford acess to the cavities defined by the bulkheads 29 and 31, respectively, so that a rider may store various paraphernalia in these cavities. For example, the rider may store camping material in the cavities when sailing. When not sailing, various other things may be stored in the cavities, such as the sail.

Figure 9:
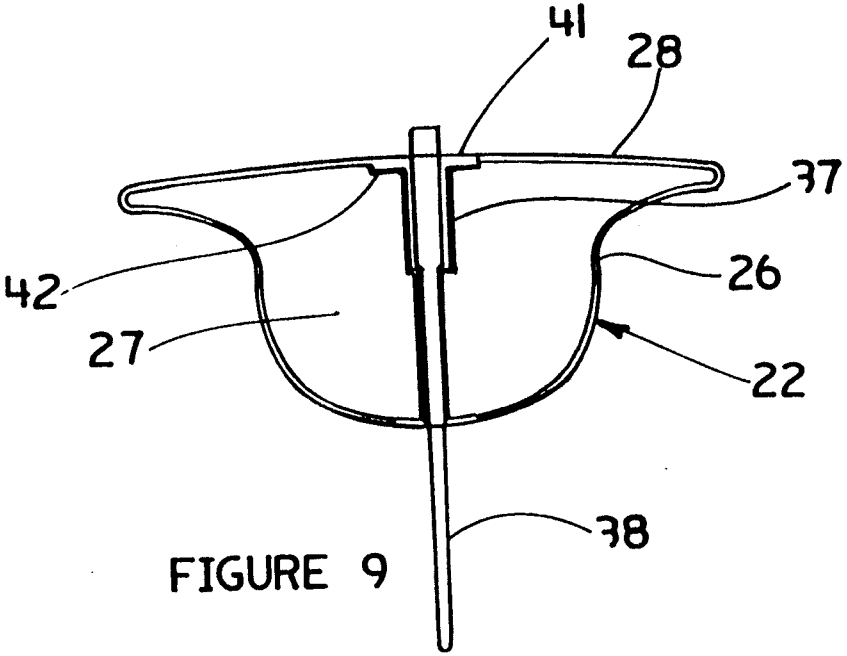
FIG. 9 is a cross-sectional view of the main hull in the area where the dagger board is inserted.
Figure 8:
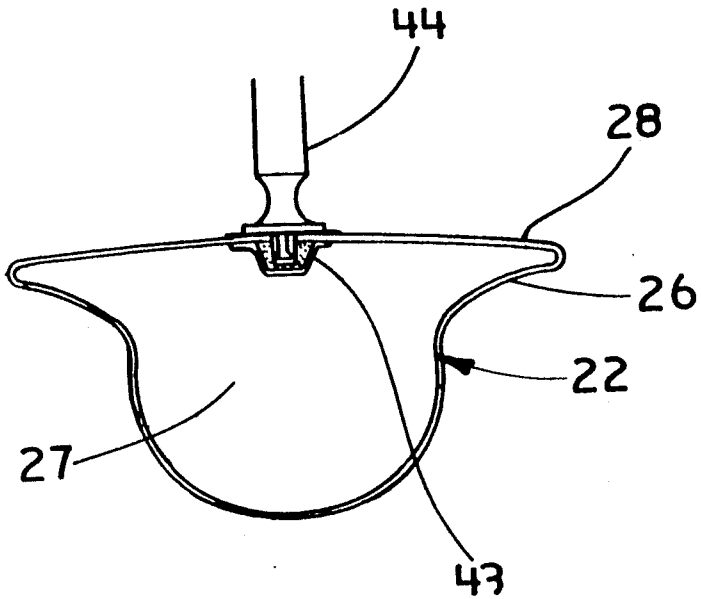
FIG. 8 is a cross-sectional view taken through the main hull taken generally through the area where the mast is supported.

A dagger board pocket 37 is received within and seals the cavity 27 so as to accommodate a pivotally and slidably supported dagger board 38 as best shown in FIG. 9. The dagger board pocket is received within a corresponding recessed opening 39 formed in the top portion 28 rearwardly of the main portion of the deck 32. A cover plate 41 lies over a flange 42 of the dagger board pocket 37 so as to provide a smooth and neat appearance.

A slidable guide 43 (FIG. 8) is also formed in the deck portion 32 so as to accommodate a base 44 of the mast assembly 24. The base 44 has a universal pivotal connection to the remainder of the mast so that the mast can be pivoted to the desired angle. The longitudinal position of the mast 24 in the slot 43 can be locked in a suitable manner.

The deck portion 32 is formed with a pair of transversely extending recesses 45 that are adapted to receive tubular members 46 which, in turn, have recesses so as to accommodate the outriggers 25. The recesses 45 and tubular members 46 are disposed immediately above the bulkheads 29 and 31 so that the load from the sponsons 23 transmitted through the outriggers 25 will be transmitted to this reinforced portion of the main hull 22.

A plurality of foot straps 47 may be affixed to the deck portion 32 so as to accommodate the rider's feet and permit him to obtain a good foot grip.

The rear of the hull is provided with a trim tab 48 for assisting in stability.

Figure 6:
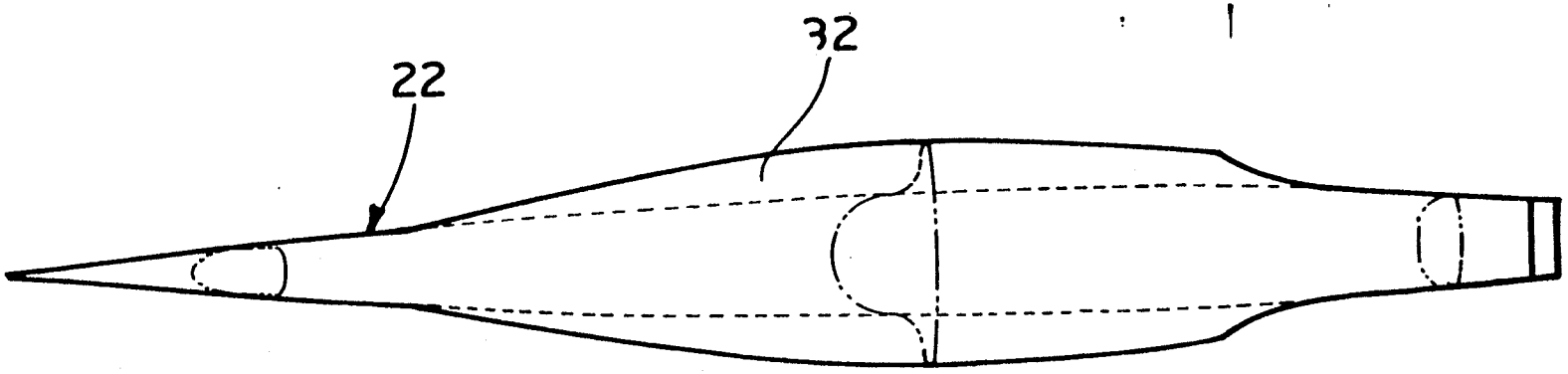
FIG. 6 is a top plan view of the main hull and shows the cross sectional configuration at portions along the length.
Figure 7:
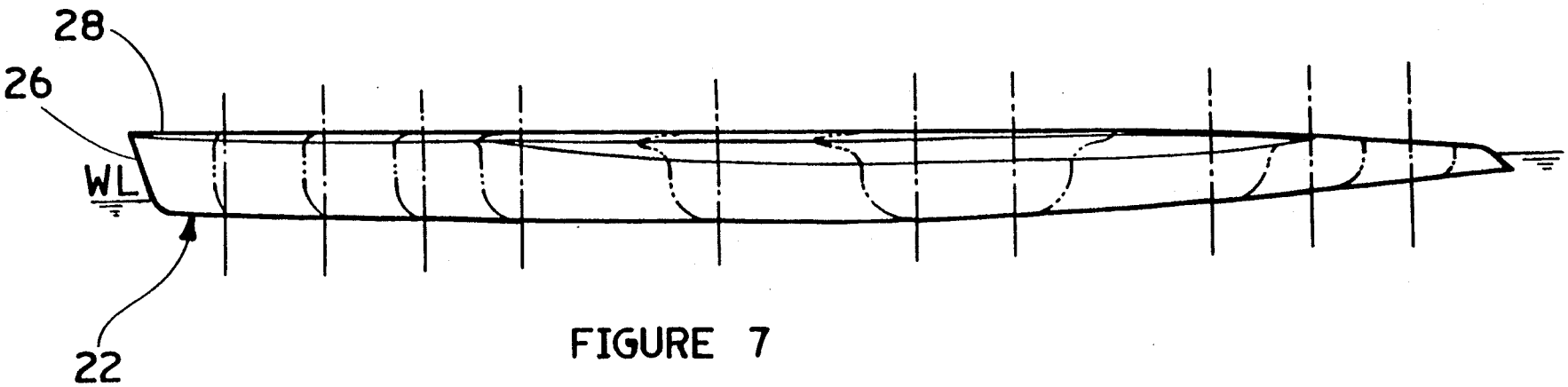
FIG. 7 is a side elevational view of the main hull with the cross-sections at various locations shown in phantom lines.

It should be noted from FIGS. 6 and 7 that the lower hull portion 26 has a generally knife edged front that gradually tapers back to a wider section. At the center point as indicated by the line 48, this configuration is generally arcuate at the lower portion. However, the upper portion curves outwardly so that the deck portion 32 is substantially wider than the lower hull portion 26 which, in effect, comprises a displacement hull. The configuration moving to the flattened back edge 49 of the lower hull part 26 is more blunted in shape than the leading end. As a result, the configuration has been found to provide very good handling and stability in all wave and wind conditions.

There is further provided a compass 51 forwardly of the deck portion 32 on the top plate 28.

Figure 2:
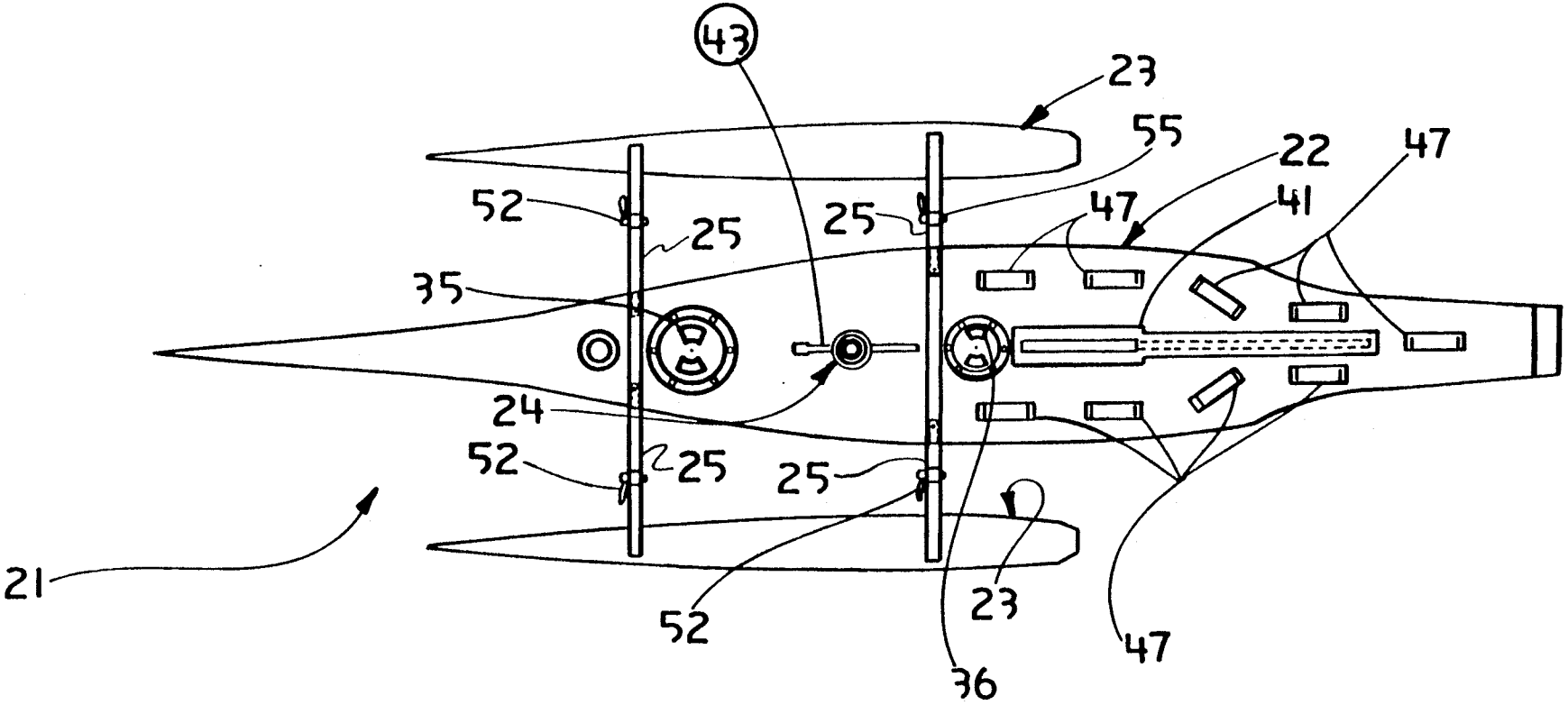
FIG. 2 is a top plan view thereof with the mast removed.
Figure 3:
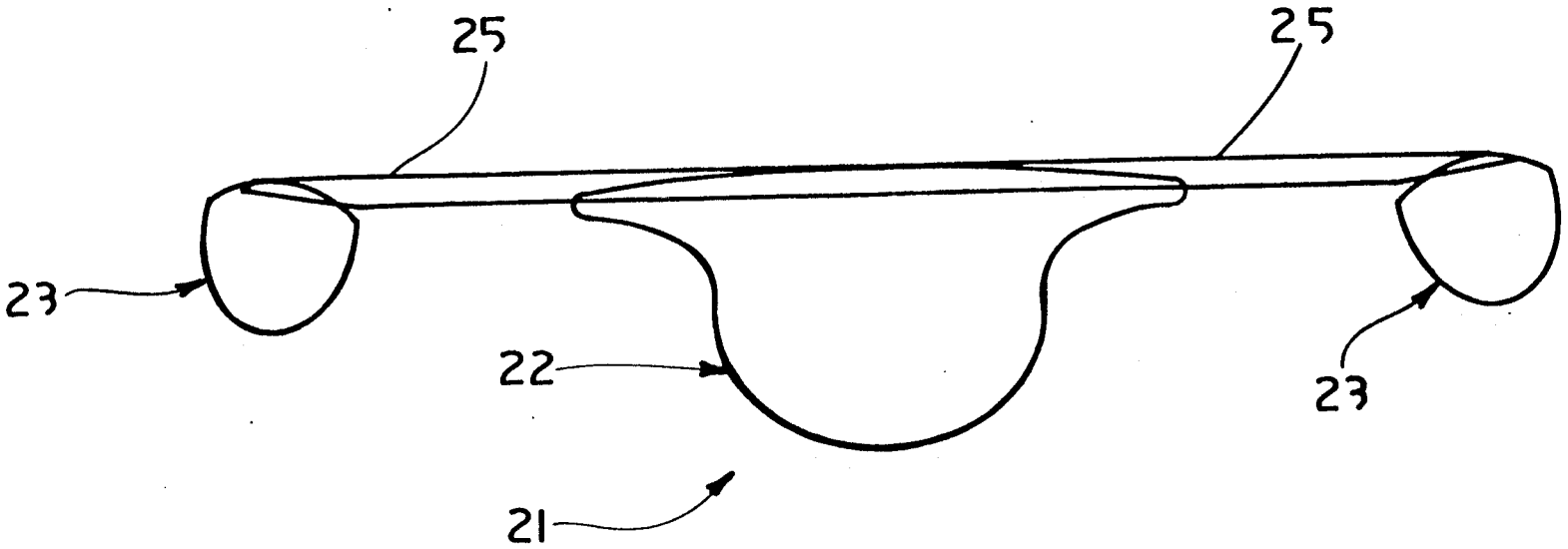
FIG. 3 is an enlarged end elevational view thereof.
Figure 4:
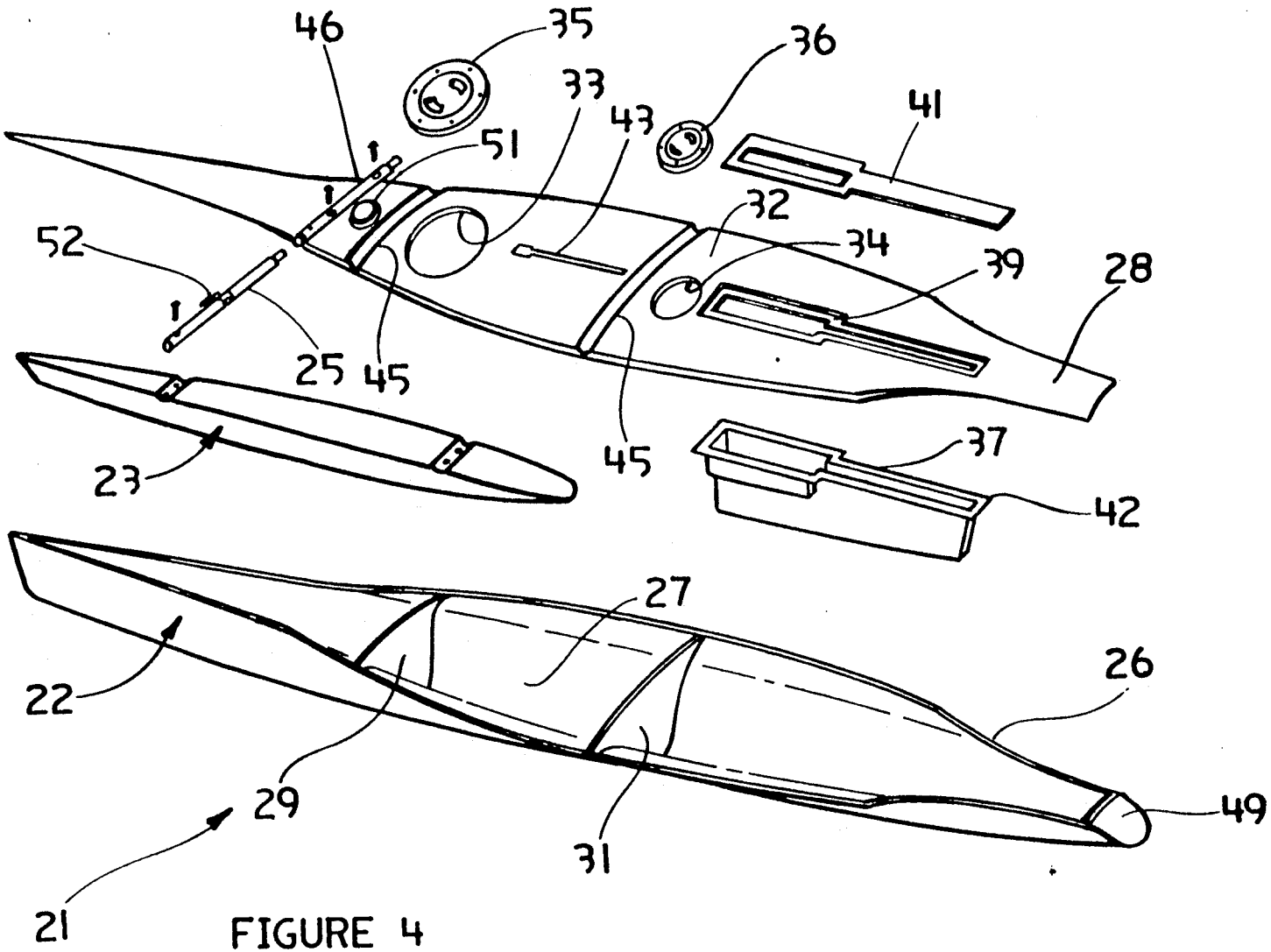
FIG. 4 is a partially exploded partial perspective view of the watercraft showing primarily the main hull and one sponson.
Figure 5:
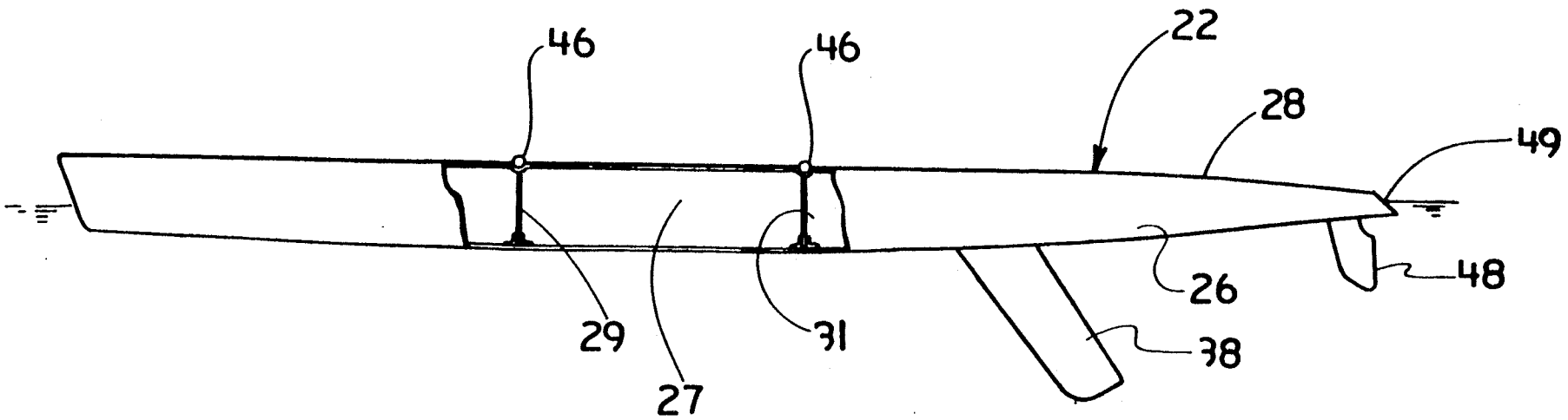
FIG. 5 is a side elevational view of the main hull, with a portion broken away.

As may be seen in FIG. 2, the outriggers 25 are angularly adjustable and a clamping device 52 is provided so that their angle may be adjusted and locked. The outer ends of the outriggers 25 are received within selected pairs of pockets formed in the sponsons 23 so that some adjustment in the longitudinal position of the sponsons 23 relative to the main hull 22 as possible, as aforenoted. However, it should be noted that the sponsons 23 are positioned so that their trailing edges extends well forwardly of the deck area 32. As a result, this facilitates launching of the watercraft 21 from a beach area and entry on to the deck area from the rear.

Figure 10:
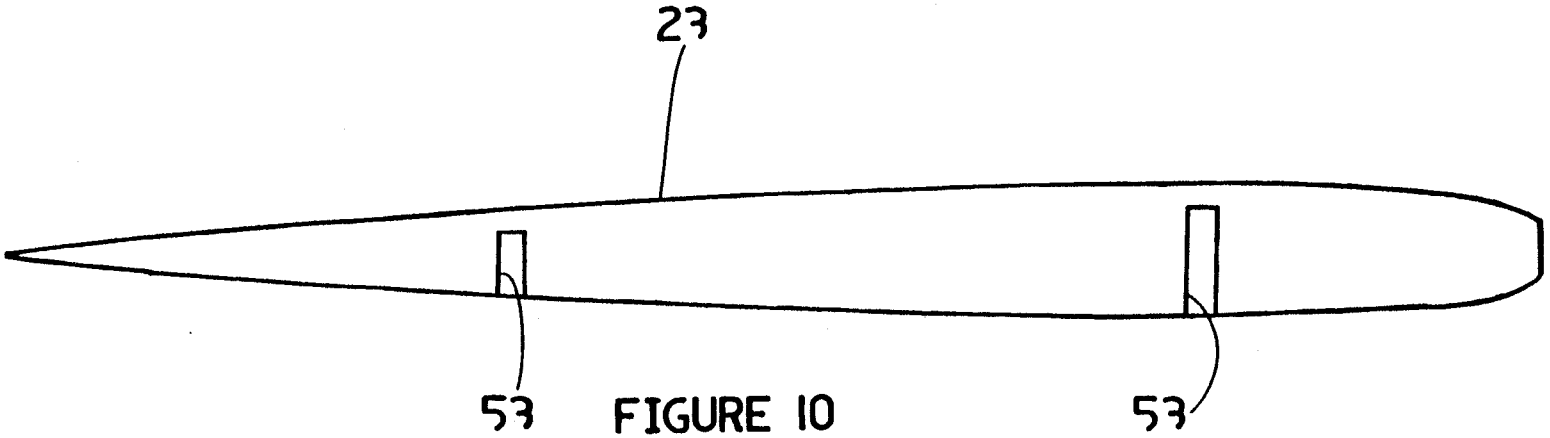
FIG. 10 is a top plan view of one of the sponsons.
Figure 11:
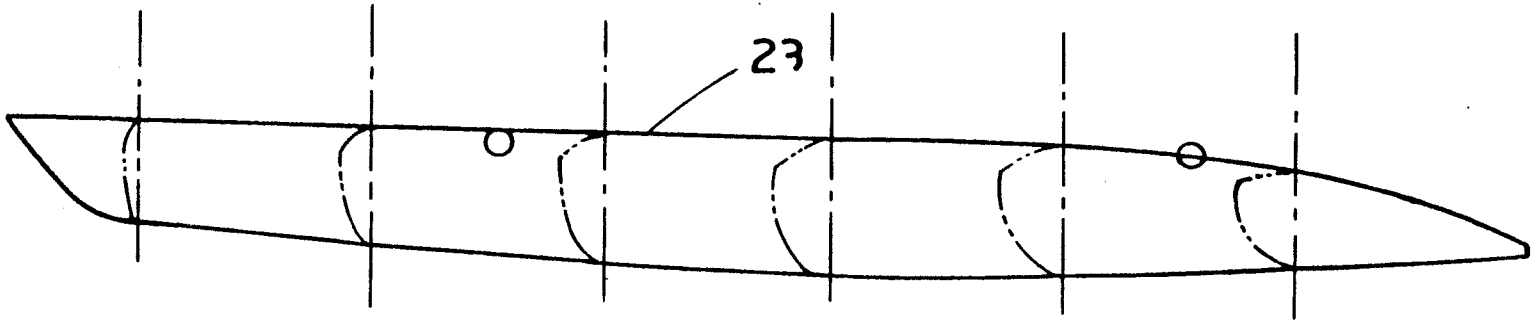
FIG. 11 is a side elevational view of the sponson with the cross-sectional configuration at various points along the length shown in phantom.

As may be seen in FIGS. 10 and 11, the sponson 23 have a generally knife shaped front end that gradually increases in cross-sectional area toward the rear and the shape generally is complementary to the corresponding portions along the length of the main hull 22. However, the sponsons 23 are not provided with any deck area for obvious reasons. Two of the pockets 53 for receiving the outriggers 25 are depicted in this figure. As noted, further pairs of pockets can be provided to afford length adjustment.

It should be readily apparent from the foregoing description that the illustrated embodiment, which is that of a preferred embodiment only, is well suited to serve the intended purposes and achieves the objects of the invention. Although this is a preferred embodiment, various changes and modifications may be made without departing from the spirit and scope of the invention, as defined by the appended claims.

What is claimed is:

1. A small sailing watercraft for primarily a single rider operating the watercraft in standing fashion thereon comprised of a main hull having a substantially greater length than width and comprised of a relatively narrow displacement hull, a deck integrally formed at the upper central portion of said displacement hull, extending transversely outwardly from said displacement hull a substantial distance and sized to accommodate a rider standing thereupon, a mast pivotally supported on said main hull and adapted to carry a sail, and at least one sponson carried at one side of said main hull at a point spaced therefrom by at least one outrigger, said sponson and said displacement hull having sufficient buoyancy so that said deck is substantially entirely above the water line to avoid drag.

2. A small sailing watercraft as set forth in claim 1 wherein the leading edge of the main hull displacement portion has a knife edge.

3. A small sailing watercraft as set forth in claim 2 wherein the cross-section of the hull increases in width from the leading edge to the area under the deck and then decreases toward the trailing end of the main hull.

4. A small sailing watercraft as set forth in claim 3 wherein the portion of the main hull beneath the deck has a generally arcuate lower end.

5. A small sailing watercraft as set forth in claim 3 wherein the hull lower portion has a reverse curve portion at the upper end thereof joining it to the deck.

6. A small sailing watercraft as set forth in claim 5 wherein the portion of the main hull beneath the deck has a generally arcuate lower end.

7. A small sailing watercraft as set forth in claim 1 wherein the main hull is substantially hollow.

8. A small sailing watercraft as set forth in claim 7 wherein the hollow main hull is reinforced by at least one transversely extending bulkhead.

9. A small sailing watercraft as set forth in claim 8 wherein the bulkhead is formed in the area where the outrigger is connected to the main hull.

10. A small sailing watercraft as set forth in claim 9 wherein there are a pair of outriggers connecting the sponson to the main hull and a pair of bulkheads reinforcing the main hull each disposed adjacent to the point where the outriggers are connected to the main hull.

11. A small sailing watercraft as set forth in claim 10 wherein the outriggers are disposed on opposite sides of the pivotal support for the mast.

12. A small sailing watercraft as set forth in claim 10 further including access means in the deck affording access to the hollow interior of the main hull for storage purposes and a hatch cover closing said access means.

13. A small sailing watercraft as set forth in claim 12 wherein the access means is formed in the central portion of the deck.

14. A small sailing watercraft as set forth in claim 7 wherein there are a pair of outriggers connecting the sponson to the main hull and a pair of bulkheads reinforcing the main hull each disposed adjacent to the point where the outriggers are connected to the main hull.

15. A small sailing watercraft as set forth in claim 14 further including access means in the deck affording access to the hollow interior of the main hull for storage purposes and a hatch cover closing said access means.

16. A small sailing watercraft as set forth in claim 15 wherein the access means is formed in the central portion of the deck.

17. A small sailing watercraft as set forth in claim 1 wherein there are a pair of outriggers for securing the sponson to the main hull and disposed on opposite sides of the point where the mast is pivotally connected to the main hull.

18. A small sailing watercraft as set forth in claim 17 further including reinforcing means in the main hull adjacent the connection of the outriggers thereto.

19. A small sailing watercraft as set forth in claim 18 including means for adjusting the mast for fore and aft movement relative to the main hull.

20. A small sailing watercraft as set forth in claim 18 wherein the deck is substantially wider than the adjacent portion of the main hull.

21. A small sailing watercraft as set forth in claim 17 wherein the sponson is located so that its trailing end is substantially forward of the rear end of the deck portion and in proximity to the midpoint thereof.

22. A small sailing watercraft as set forth in claim 21 further including reinforcing means in the main hull adjacent the connection of the outriggers thereto.

23. A small sailing watercraft as set forth in claim 22 including means for adjusting the mast for fore and aft movement relative to the main hull.

24. A small sailing watercraft as set forth in claim 23 wherein the deck is substantially wider than the adjacent portion of the main hull.

25. A small sailing watercraft for primarily a single rider operating said watercraft in a standing position comprised of a main hull having a lower part defining a generally longitudinally extending cavity and closed by an upper deck portion, a pair of bulkheads extending transversely across said cavity for reinforcing said hull, a mast pivotally supported on said main hull and adapted to carry a sail, and a sponson at one side of said main hull outwardly thereof and affixed to said main hull portion by a pair of outriggers, each of said outriggers being connected to said main hull contiguous to a respective one of said bulkheads.

26. A small sailing watercraft as set forth in claim 25 wherein the outriggers are disposed on opposite sides of the pivotal support for the mast.

27. A small sailing watercraft as set forth in claim 25 further including access means in the deck affording access to the hollow interior of the main hull for storage purposes and a hatch cover closing said access means.

28. A small sailing watercraft as set forth in claim 27 wherein the access means is formed in the central portion of the deck.

29. A small sailing watercraft as set forth in claim 25 wherein the sponson is located so that its trailing end is substantially forward of the rear end of the deck portion and in proximity to the midpoint thereof.

30. A small sailing watercraft as set forth in claim 25 wherein there are a pair of sponsons at opposite sides of the main hull outwardly therefrom and each affixed to the main hull by the pair of outriggers.

31. A small sailing watercraft for primarily a single rider operating the watercraft in standing fashion thereon comprised of a main hull having a substantially greater length than width and comprised of a relatively narrow displacement hull, a deck formed at the upper central portion of said displacement hull, extending transversely outwardly from said displacement hull and sized to accommodate a rider standing thereon, a mast pivotally supported on main hull and adapted to carry a sail, and at least one sponson carried at one side of said main hull at a point spaced outwardly therefrom by at least one outrigger, a portion of said main hull beneath said deck, having a generally arcuate lower end and joined at the upper end thereof to said deck by reversely curved portions at opposite sides thereof.

32. A small sailing watercraft as set forth in claim 31 wherein the leading edge of the main hull displacement portion has a knife edge.

33. A small sailing watercraft as set forth in claim 32 wherein the cross section of the hull increases in width from the leading edge to the area under the deck and then decreases toward the trailing end of the main hull.

* * * * *